US011211697B2

(12) United States Patent
Yun et al.

(10) Patent No.: US 11,211,697 B2
(45) Date of Patent: Dec. 28, 2021

(54) ANTENNA APPARATUS

(71) Applicant: TE CONNECTIVITY CORPORATION, Berwyn, PA (US)

(72) Inventors: Xing Yun, Harrisburg, PA (US); Bruce Foster Bishop, Aptos, CA (US)

(73) Assignee: TE Connectivity Services GmbH

( * ) Notice: Subject to any disclaimer, the term of this patent is extended or adjusted under 35 U.S.C. 154(b) by 703 days.

(21) Appl. No.: 15/782,845

(22) Filed: Oct. 12, 2017

(65) Prior Publication Data

US 2019/0115652 A1 Apr. 18, 2019

(51) Int. Cl.
*H01Q 5/371* (2015.01)
*H01Q 9/04* (2006.01)
(Continued)

(52) U.S. Cl.
CPC ..... *H01Q 1/422* (2013.01); *H01Q 1/38* (2013.01); *H01Q 1/46* (2013.01); *H01Q 5/371* (2015.01); *H01Q 9/0407* (2013.01); *H01Q 9/0421* (2013.01); *H01Q 9/0442* (2013.01); *H01Q 1/243* (2013.01); *H01Q 5/385* (2015.01)

(58) Field of Classification Search
CPC .... H01Q 9/065; H01Q 9/0407; H01Q 9/0414; H01Q 5/364–378; H01Q 9/16; H01Q 9/42; H01Q 1/38; H01Q 9/26; H01Q 9/0442; H01Q 9/0421; H01Q 5/49; H01Q 5/385–392; H01Q 9/0435; H01Q 5/15; H01Q 9/285; H01Q 9/38; H01Q 9/44; H01Q 11/16; H01Q 5/35; H01Q 5/378
See application file for complete search history.

(56) References Cited

U.S. PATENT DOCUMENTS 7,256,743 B2 6/2007 Korva
7,453,402 B2 11/2008 Rowell et al.
(Continued)

FOREIGN PATENT DOCUMENTS

CN 101361282 A 2/2009
CN 103117452 A 5/2013
(Continued)

OTHER PUBLICATIONS

International Search Report, International Application No. PCT/IB2018/057637, International Filing Date Oct. 2, 2018.
(Continued)

*Primary Examiner* — Ricardo I Magallanes

(57) ABSTRACT

Antenna apparatus includes a driven trace coupled to a dielectric body and extending parallel to a ground plane. The driven trace includes first and second branches and an impedance-tuning portion that joins the first and second branches. Each of the first and second branches are configured to resonate at a respective radio-frequency (RF) band. The respective RF bands may or may not be the same. The antenna apparatus also includes a first conductive pathway extending from the driven trace through the dielectric body and configured to feed the driven trace. The antenna apparatus also includes a second conductive pathway that extends from the driven trace through the dielectric body and electrically connects the driven trace to the ground plane. The impedance-tuning portion extends between the first and second conductive pathways.

20 Claims, 3 Drawing Sheets

(51) Int. Cl.

| | |
|---|---|
| ***H01Q 1/38*** | (2006.01) |
| ***H01Q 1/42*** | (2006.01) |
| ***H01Q 1/46*** | (2006.01) |
| *H01Q 5/385* | (2015.01) |
| *H01Q 1/24* | (2006.01) |

(56) References Cited

U.S. PATENT DOCUMENTS

| | | | | |
|---|---|---|---|---|
| 2005/0078037 | A1 | 4/2005 | Leclerc et al. | |
| 2005/0093750 | A1* | 5/2005 | Vance | H01Q 5/378 343/702 |
| 2006/0055602 | A1* | 3/2006 | Huber | H01Q 5/392 343/700 MS |
| 2009/0128439 | A1* | 5/2009 | Su | H01Q 1/243 343/795 |
| 2010/0253581 | A1 | 10/2010 | Tsou | |
| 2012/0293387 | A1* | 11/2012 | Ohno | H01Q 9/285 343/818 |
| 2014/0168023 | A1* | 6/2014 | Wolf | H01Q 9/285 343/767 |
| 2015/0123853 | A1* | 5/2015 | Wu | H01Q 5/371 343/700 MS |
| 2017/0047642 | A1* | 2/2017 | Li | H01Q 5/10 |
| 2017/0125916 | A1* | 5/2017 | Camacho | H01Q 1/48 |
| 2018/0277955 | A1* | 9/2018 | Yoo | H01Q 5/364 |

FOREIGN PATENT DOCUMENTS

| | | |
|---|---|---|
| CN | 103682585 A | 9/2014 |
| EP | 2418732 A2 | 2/2012 |

OTHER PUBLICATIONS

Chinese Search Report from First Office Action, Chinese Application No. 201880066218.3 dated Nov. 18, 2020.

* cited by examiner

| Bandwidth | Return Loss |
|---|---|
| 2.4-2.5 GHz | <-6 dB |
| 5.15-5.35 GHz | <-5 dB |
| 5.47-5.725 GHz | <-5 dB |
| 5.725-5.785 GHz | <-5 dB |

ANTENNA APPARATUS

BACKGROUND

The subject matter relates generally to antenna apparatuses having multiple branches.

Antennas are increasingly requested and used for a number of applications within a variety of industries. Examples of such applications include mobile phones, wearable devices, portable computers, and communication systems for vehicles (e.g., automobiles, trains, planes, etc.). But there have been conflicting market demands for such antennas. Users and vendors request multi-band capabilities but would like the antennas to be smaller, hidden, and/or positioned at non-ideal locations, such as near other metal objects.

To meet these demands, manufacturers have attempted to optimize the available space by resizing components or by moving the components to different locations. Although these antennas can be effective in communicating wirelessly, alternative antennas which provide sufficient communication while occupying less space are still desired. In particular, it has become increasingly difficult to achieve greater bandwidth for smaller antennas. For instance, a conventional monopole antenna can extend several centimeters. As the monopole antenna becomes shorter, it becomes increasingly difficult to achieve a desired bandwidth.

Accordingly, there is a need for an antenna apparatus that occupies less space but has a greater bandwidth than conventional antennas with a similar size.

BRIEF DESCRIPTION

In an embodiment, an antenna apparatus is provided. The antenna apparatus includes a dielectric body having first and second broad sides and a thickness of the dielectric body extending therebetween. The antenna apparatus also includes a ground plane coupled to the dielectric body. The antenna apparatus also includes a driven trace coupled to the dielectric body and extending parallel to the ground plane. The driven trace includes first and second branches and an impedance-tuning portion that joins the first and second branches. Each of the first and second branches are configured to resonate at a respective radio-frequency (RF) band. The respective RF bands may or may not be the same. The antenna apparatus also includes a first conductive pathway extending from the driven trace through the dielectric body and configured to feed the driven trace. The antenna apparatus also includes a second conductive pathway that extends from the driven trace through the dielectric body and electrically connects the driven trace to the ground plane. The impedance-tuning portion extends between the first and second conductive pathways.

In some aspects, the driven trace and the ground plane are separated by at most three millimeters.

In some aspects, a parasitic trace is coupled to the dielectric body. The parasitic trace may be co-planar with respect to the driven trace. The parasitic trace is ungrounded and positioned adjacent to an edge of the driven trace. The driven trace excites the parasitic trace to resonate at a respective RF band.

In some aspects, the parasitic trace is a first parasitic trace and the driven trace excites the first parasitic trace to resonate at a first respective RF band. The antenna apparatus also includes a second parasitic trace. The second parasitic trace is co-planar with respect to the driven trace. The second parasitic trace is ungrounded and positioned adjacent to an edge of the driven trace. The driven trace excites the second parasitic trace to resonate at a second respective RF band.

In some aspects, the first branch is positioned between the first and second parasitic traces. The first and second branches resonate at the same RF band.

In some aspects, the driven trace also includes a third branch coupled to the impedance-tuning portion. The third branch is configured to resonate at a respective RF band.

In some aspects, the second and third branches extend away from the impedance-tuning portion in one direction. The first branch extends away from the impedance-tuning portion in an opposite direction.

In some aspects, the antenna apparatus also includes a printed circuit that has the driven trace and the first and second conductive pathways.

In an embodiment, a communication system includes the above antenna apparatus and also includes a metallic surface. The ground plane is positioned adjacent to the metallic surface.

In some aspects, the communication system also includes a printed circuit that has the driven trace and the first and second conductive pathways.

In an embodiment, a low-profile antenna apparatus is provided that includes a dielectric body having first and second broad sides and a thickness of the dielectric body extending therebetween. The antenna apparatus also includes a ground plane and a driven trace supported by the dielectric body and extending parallel to the ground plane. The driven trace and the ground plane are separated by at most three millimeters. The driven trace includes first and second branches. Each of the first and second branches is configured to resonate at a radio-frequency (RF) band. The RF band may or may not be the same band. The antenna apparatus also includes a parasitic trace coupled to the dielectric body. The parasitic trace is ungrounded and positioned adjacent to an edge of the first branch of the driven trace. The driven trace excites the parasitic trace to resonate at a respective RF band.

In some aspects, the antenna apparatus also includes a first conductive pathway extending from the driven trace through the dielectric body and configured to feed the driven trace. The antenna apparatus also includes a second conductive pathway extending from the driven trace through the dielectric body and electrically connecting the driven trace to the ground plane. The impedance-tuning portion extends between the first and second conductive pathways.

In some aspects, the driven trace and the ground plane are separated by at most three millimeters.

In some aspects, the parasitic trace is a first parasitic trace and the driven trace excites the first parasitic trace to resonate at a first respective RF band. The antenna apparatus also includes a second parasitic trace. The second parasitic trace is co-planar with respect to the driven trace. The second parasitic trace is ungrounded and positioned adjacent to an edge of the driven trace. The driven trace excites the second parasitic trace to resonate at a second respective RF band.

In some aspects, the first branch is positioned between the first and second parasitic traces.

In some aspects, the driven trace also includes an impedance-tuning portion that joins the first and second branches and a third branch coupled to the impedance-tuning portion. The third branch is configured to resonate at a respective RF band.

In some aspects, the second and third branches extend away from the impedance-tuning portion in one direction.

The first branch extends away from the impedance-tuning portion in an opposite direction.

In some aspects, The antenna apparatus also includes a printed circuit that includes the driven trace and the parasitic trace.

In an embodiment, a communication system is provided that includes the above antenna apparatus. The communication system also includes a metallic surface. The ground plane is positioned adjacent to the metallic surface.

In some aspects, the communication system includes a printed circuit that includes the driven trace and the parasitic trace.

DETAILED DESCRIPTION

Figure 1:
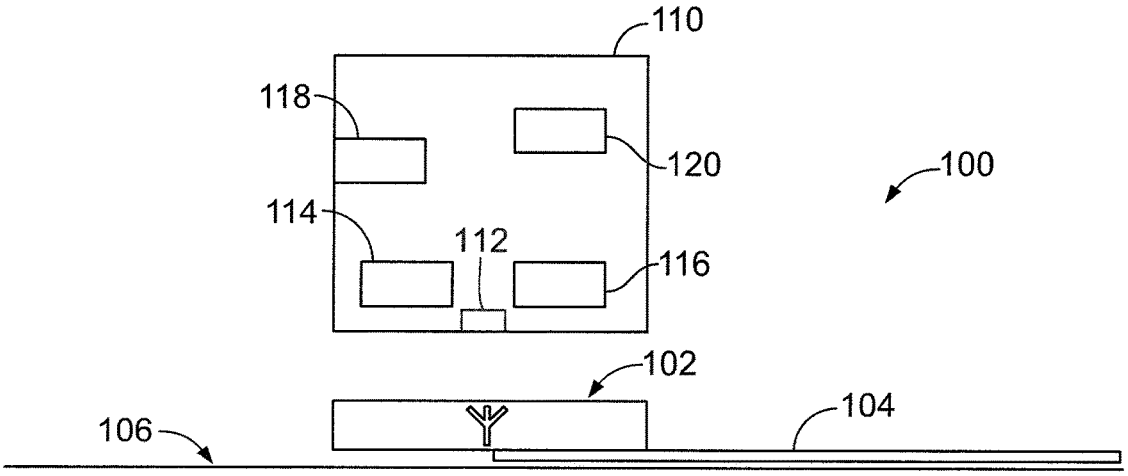
FIG. 1 illustrates a communication system including an antenna apparatus formed in accordance with an embodiment.

Embodiments set forth herein include antenna apparatuses. The antenna apparatuses include a dielectric body and conductive elements that are operably coupled to the dielectric body. In some embodiments, the antenna apparatus may be referred to as a multi-band antenna apparatus. Optionally, the antenna apparatuses may be "low-profile." As used herein, a low-profile antenna apparatus is one in which the conductive elements extend parallel to one another and are separated by a distance that is less than 3.0% of a wavelength of the operating frequency. In particular embodiments, the conductive elements are separated by a distance that is less than 2.0% of a wavelength of the operating frequency or less than 1.5% of a wavelength of the operating frequency. In certain embodiments, the conductive elements are separated by a distance that is less than 1.0% of a wavelength of the operating frequency or about 0.8% of a wavelength of the operating frequency. In some embodiments, the conductive elements (e.g., driven trace and ground plane) extend parallel to one another and are separated by a distance that is no more than five millimeters. In some embodiments, the conductive elements are separated by a distance that is no more than three millimeters or no more than two millimeters. In certain embodiments, the conductive elements are separated by a distance that is no more than 1.5 millimeters or 1.1 millimeters.

In some embodiments, the antenna apparatus may be part of a larger system and positioned adjacent to metal objects. For example, the antenna apparatus may be coupled to a metallic surface, such as a frame of a device.

In the illustrated embodiment, the antenna apparatus may be manufactured through known printed circuit board (PCB) technologies. The antenna apparatus for such embodiments may be a laminate or sandwich structure that includes a plurality of stacked substrate layers. Each substrate layer may include, at least partially, an insulating dielectric material. By way of example, the substrate layers may include a dielectric material (e.g., flame-retardant epoxy-woven glass board (FR4), polyimide, polyimide glass, polyester, epoxy-aramid, and the like); a bonding material (e.g., acrylic adhesive, modified epoxy, phenolic butyral, pressure-sensitive adhesive (PSA), preimpregnated material, and the like); a conductive material that is disposed, deposited, or etched in a predetermined manner; or a combination of the above. The conductive material may be copper (or a copper-alloy), cupro-nickel, silver epoxy, conductive polymer, and the like. It should be understood that substrate layers may include sub-layers of, for example, bonding material, conductive material, and/or dielectric material. The dielectric body may include only a single dielectric element or may include a combination of dielectric elements. In certain embodiments, the antenna apparatus may be or include a printed circuit and, more specifically, a printed circuit board.

It should be understood, however, that the antenna apparatus 200 may be manufactured through other methods, such as laser direct structuring (LDS), two-shot molding (dielectric with copper traces), and/or ink-printing. As described above, structural components may be manufactured by molding a dielectric material (e.g., thermoplastic) into a designated shape. Conductive elements (e.g., traces) may then be disposed on surfaces of the mold through, for example, ink-printing. Alternatively, conductive elements may be first formed and then a dielectric material may be molded around the conductive components. For example, the conductive elements may be stamped from sheet metal, disposed within a cavity, and then surrounded by a thermoplastic material that is injected into the cavity.

Embodiments may communicate within one or more radio-frequency (RF) bands. For purposes of the present disclosure, the term "RF" is used broadly to include a wide range of electromagnetic transmission frequencies including, for instance, those falling within the radio frequency, microwave, or millimeter wave frequency ranges. An RF band may also be referred to as a frequency band. An antenna apparatus may communicate through one or more RF bands (or frequency bands). In particular embodiments, the antenna apparatus communicates through multiple frequency bands. For example, in some embodiments, the antenna apparatus has one or more center frequencies within the range of 2.4-2.5 GHz and one or more center frequencies within the range of 5.15-5.875 GHz. For example, the antenna apparatus may have a first RF band that is centered at 2.45 GHz, a second RF band that is centered at 5.25 GHz, a third RF band that is centered at 5.6 GHz, and a RF band that is centered at 5.8 GHz. It should be understood, however, that wireless devices and antenna apparatus described herein are not limited to particular RF bands and other RF bands may be used. Likewise, it should be understood that antenna apparatuses described herein are not limited to particular wireless technologies (e.g., WLAN, Wi-Fi, WiMax) and other wireless technologies may be used. Optionally, embodiments may be configured for global navigation satellite system (GNSS) or a global positioning system (GPS).

FIG. 1 is a schematic illustration of a communication system 100 formed in accordance with an embodiment. In an exemplary embodiment, the communication system 100 forms part of a larger system, such as a computer (e.g., desktop or portable), mobile phone, or a vehicle (e.g., automobiles, trains, planes). The communication system 100 includes an antenna apparatus 102, a cable 104, and a surface 106. The surface 106 may be a metal (or conductive surface). For example, the antenna apparatus 102 may be secured to a frame of a radio. The communication system 100 also includes system circuitry 110 that is communicatively coupled to the antenna apparatus 102 and may control operation of the antenna apparatus 102. Although only one antenna apparatus 102 is shown in FIG. 1, other embodiments may include more than one antenna apparatus.

The system circuitry 110 includes a module (e.g., transmitter/receiver) 112 that decodes the signals received from the antenna apparatus 102 and/or transmitted by the antenna apparatus 102. In other embodiments, however, the module may be a receiver that is configured for receiving only (e.g., GPS). The system circuitry 110 may also include one or more processors 114 (e.g., central processing units (CPUs), microcontrollers, field programmable arrays, or other logic-based devices), one or more memories 116 (e.g., volatile and/or non-volatile memory), and one or more data storage devices 118 (e.g., removable storage device or non-removable storage devices, such as hard drives). The system circuitry 110 may also include a wireless control unit 120 (e.g., mobile broadband modem) that enables the communication system 100 to communicate via a wireless network. The communication system 100 may be configured to communicate according to one or more communication standards or protocols (e.g., Wi-Fi, Bluetooth, cellular standards, etc.).

During operation of the communication system 100, the communication system 100 may communicate through the antenna apparatus 102. To this end, the antenna apparatus 102 may include conductive elements that are configured to exhibit electromagnetic properties that are tailored for desired applications. For instance, the antenna apparatus 102 may be configured to operate in multiple RF bands simultaneously. The structure of the antenna apparatus 102 can be configured to effectively operate in particular radio bands. The structure of the antenna apparatus 102 can be configured to select specific radio bands for different networks. The antenna apparatus 102 may be configured to have designated performance properties, such as a voltage standing wave ratio (VSWR), gain, bandwidth, and a radiation pattern.

Figure 2:
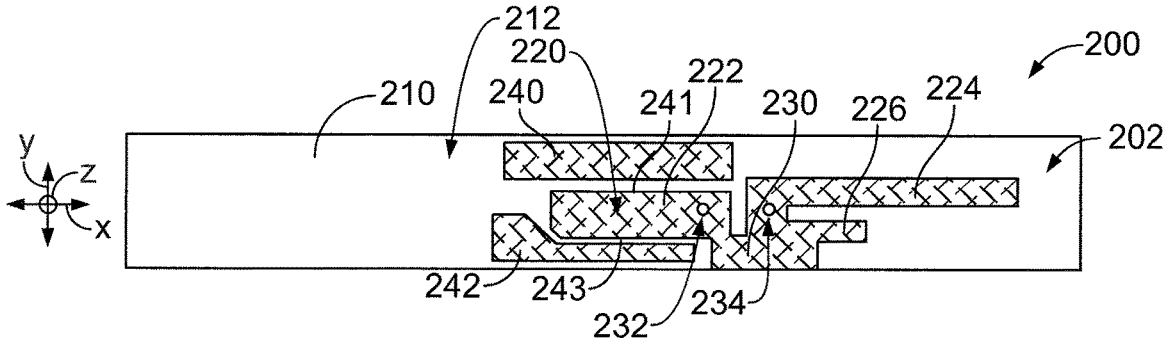
FIG. 2 is a plan view of a first level of an antenna apparatus in accordance with an embodiment.
Figure 3:
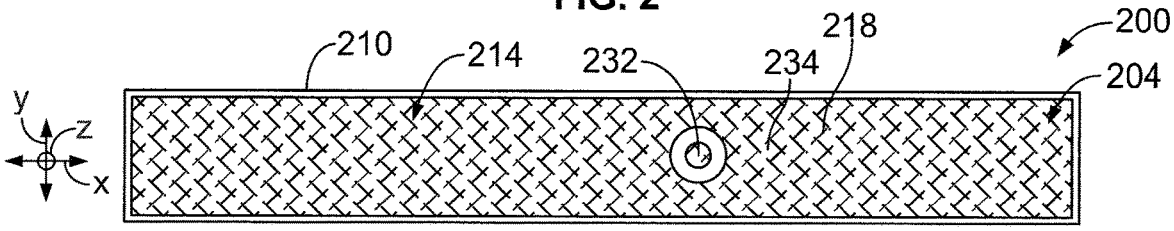
FIG. 3 is a plan view of a second level of the antenna apparatus of FIG. 2.
Figure 4:
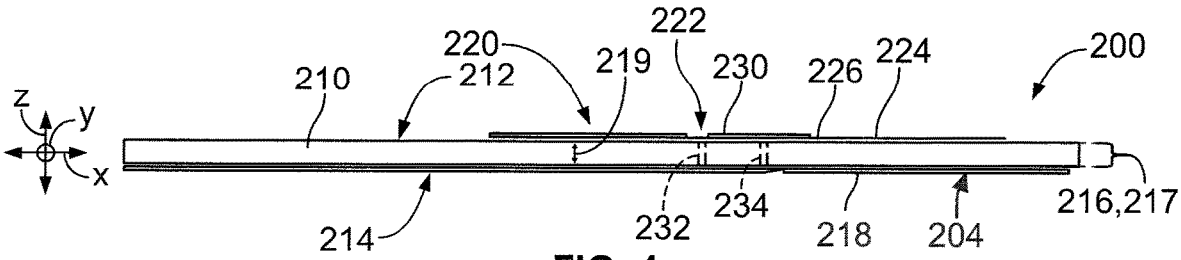
FIG. 4 is a side view of the antenna apparatus of FIG. 2.

FIGS. 2-4 illustrate an antenna apparatus 200 in greater detail. The antenna apparatus 200 may be used as the antenna apparatus 102 (FIG. 1) in the communication system 100 (FIG. 1). FIG. 2 is a plan view of a first level 202 of the antenna apparatus 200, and FIG. 3 is a plan view of a second level 204 of the antenna apparatus 200. FIG. 4 is a side view of the antenna apparatus 200. In the illustrated embodiment, the first and second levels 202, 204 are exterior broad sides of the antenna apparatus 200. However, the first and second levels are not required to be exterior broad sides. For example, in alternative embodiments, at least one of the first or second levels 202, 204 may exist a depth within the antenna apparatus 200. Dimensions of the different features of the antenna apparatus 200 are changed in FIG. 4 for illustrative purposes.

As shown in FIGS. 2-4, the antenna apparatus 200 is oriented with respect to mutually perpendicular X, Y, and Z-axes. The Z-axis extends into and out of the page in FIGS. 2 and 3. It should be understood that the X, Y, and Z-axes are only used for reference in describing the positional relationship between different elements of the antenna apparatus 200. The X, Y, and Z-axes do not have any particular orientation with respect to gravity.

As shown, the antenna apparatus 200 includes a dielectric body 210 having a first broad side 212 (FIGS. 2 and 4), a second broad side 214 (FIGS. 3 and 4), and a thickness 216 (FIG. 4) of the dielectric body 210 extending therebetween. The antenna apparatus 200 has a thickness 217 that is equal to the thickness 216 plus a thickness of a conductive element along the first broad side 212 and/or a conductive element along the second broad side 214. The antenna apparatus 200 also includes a ground plane 218 (FIGS. 3 and 4) and a driven trace 220 (FIGS. 2 and 4). In the illustrated embodiment, the ground plane 218 and the driven trace 220 are secured to and supported by the dielectric body 210 and extend parallel to one another. The driven trace 220 and the ground plane 218 are separated or spaced apart by a distance 219. The distance may be a function of wavelength as described above. In more particular embodiments, the distance 219 may be at most 2 millimeters or at most 1.5 millimeters. In certain embodiments, the distance 219 may be at most 1 millimeter.

With respect to FIGS. 2 and 4, the driven trace 220 is designed to include multiple branches associated with different RF bands. For example, the driven trace 220 includes a first branch 222 that is configured to resonate at a designated RF band and a second branch 224 that is configured to resonate at a designated RF band. Optionally, the driven trace 220 may include a third branch 226 that is configured to resonate at a designated RF band. The respective RF bands for the first, second, third branches 222, 224, 226 may be the same RF band or different RF bands. As used herein, "different RF bands" includes RF bands that partially overlap and RF bands that do not overlap. In particular embodiments, the RF bands for the first and second branches are the same, and the RF band for the third branch is different from the RF band for the first and second branches.

The antenna apparatus 200 may be a hybrid antenna as the antenna apparatus 200 includes features of at least two different types of antenna. For example, the first and second branches 222, 224 extend away from each other and, therefore, appear similar to a dipole. However, the driven trace 220 is grounded to the ground plane 218 through the second conductive pathway 234 in a manner that is similar to planar inverted-F antenna (PIFA)-type antenna.

The driven trace 220 also includes an impedance-tuning portion 230 that joins the first and second branches 222, 224. In the illustrated embodiment, the impedance-tuning portion 230 also joins the third branch 226 to the first and second branches 222, 224.

As shown in FIGS. 2-4, the antenna apparatus 200 also includes a first conductive pathway 232 (indicated by phantom lines) and a second conductive pathway 234 (indicated by phantom lines). As shown, the first conductive pathway 232 may extend between the first branch 222 and through the dielectric body 210. The first conductive pathway 232 is configured to be electrically connected to a transmission line 246 (shown in FIG. 5).

The second conductive pathway 234 is also configured to be electrically connected to the transmission line 246, such as a cable shield layer 250. More specifically, the second conductive pathway 234 extends from the second branch 224 to the ground plane 218. The second conductive pathway 234 electrically connects the second branch 224 and the third branch 226 to the ground plane 218. The second conductive pathway 234 electrically connects the driven trace 220 generally, but the second branch 224 and the third branch 226 have more direct connections to the ground plane 218 than the first branch 222. As shown in FIG. 3, the ground plane 218 covers essentially an entirety of the second broad side 214. In other embodiments, however, the ground plane 218 covers only a portion of the second broad side 214.

With respect to FIG. 2, embodiments may optionally include one or more ungrounded parasitic traces. For example, the antenna apparatus 200 includes a first parasitic trace 240 and a second parasitic trace 242. Each of the parasitic traces 240, 242 are coupled to the dielectric body 210. The parasitic traces 240, 242 may be co-planar with the driven trace 220. More specifically, the parasitic traces 240, 242 are positioned adjacent to edges 241, 243, respectively, of the first branch 222 of the driven trace 220. During operation, the first branch 222 excites the parasitic traces 240, 242 to resonate at respective RF bands.

The antenna apparatus 200 may be configured to communicate at different RF bands. For example, in some embodiments, the antenna apparatus 200 has one or more center frequencies within the range of 2.4-2.5 GHz and one or more center frequencies within the range of 5.15-5.875 GHz. For example, the antenna apparatus may have a first RF band that has a center frequency of 2.45 GHz, a second RF band that has a center frequency of 5.25 GHz, a third RF band that has a center frequency of 5.6 GHz, and a fourth RF band that has a center frequency of 5.8 GHz. It should be understood, however, that the antenna apparatus 200 may be configured to have other combinations of RF bands.

Figure 5:
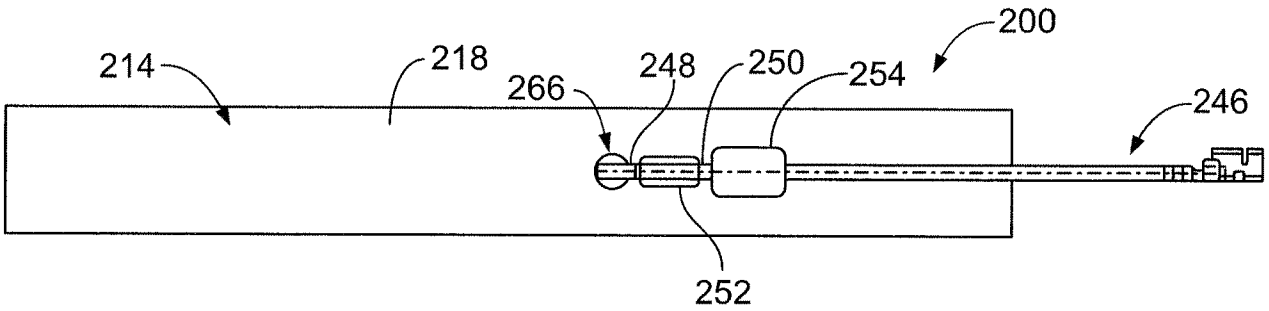
FIG. 5 is a plan view of a communication cable operably coupled to the antenna apparatus of FIG. 2.

FIG. 5 is a plan view of the second broad side 214 of the antenna apparatus 200 when operably connected to the transmission line 246. In the illustrated embodiment, the transmission line 246 is a coaxial cable having a center conductor 248 and a cable shield layer 250 that surrounds the center conductor 248. Other transmission lines, however, may be used in alternative embodiments.

The first conductive pathway 232 (FIG. 2) is configured to be electrically connected to the center conductor 248 of the transmission line 246. The ground plane 218 is configured to be electrically connected to the cable shield layer 250. For example, the cable shield layer 250 may be soldered (indicated at 252) to the ground plane 218. The transmission line 246 may be secured to the antenna apparatus 200 using an adhesive 254 (e.g., epoxy).

The driven trace 220 (FIG. 2) is electrically connected to the transmission line 246 at a feed point 266. The transmission line 246 is configured to communicate electromagnetic waves (e.g., RF waves) to the driven trace 220 through the feed point 266.

Figure 6:
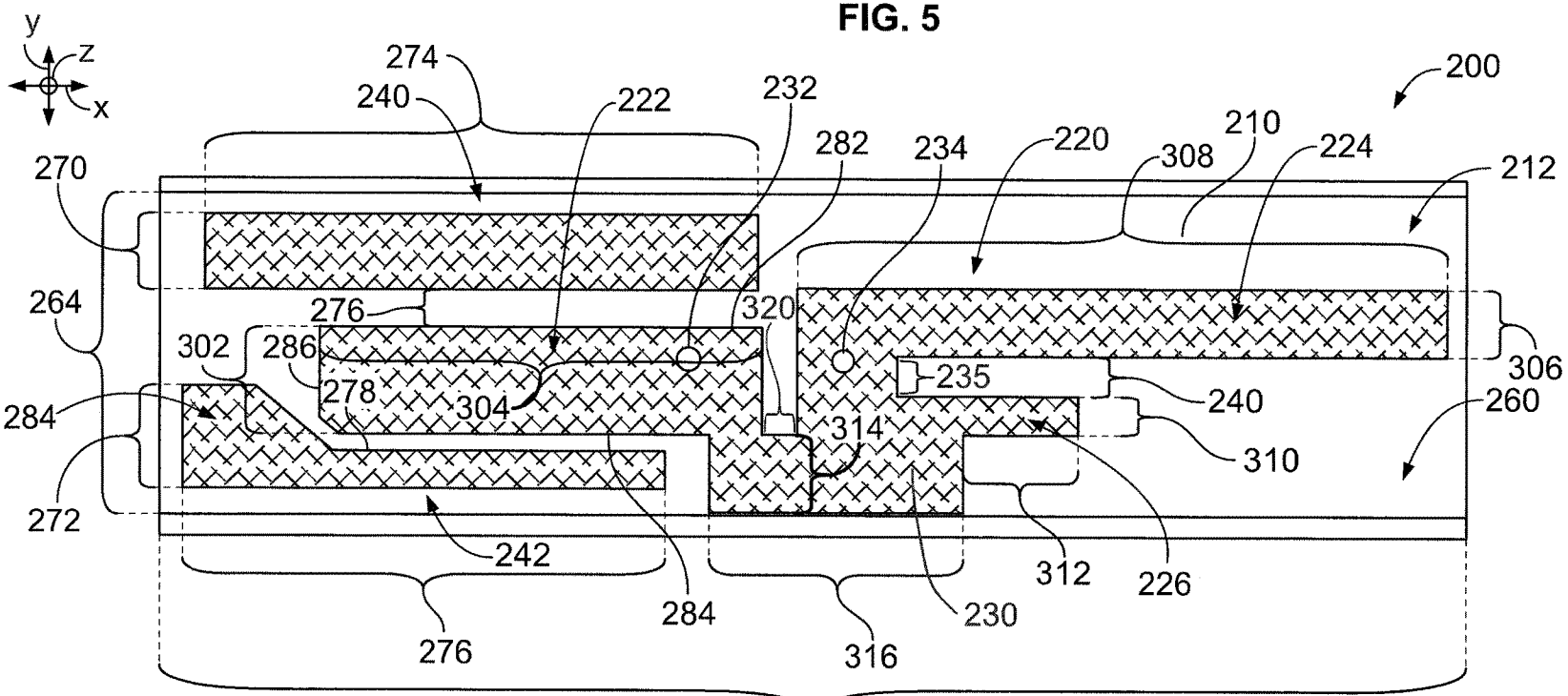
FIG. 6 is an enlarged plan view of the first level of the antenna apparatus of FIG. 2.

FIG. 6 is a plan view of the first broad side 212 of the antenna apparatus 200. The conductive elements of the antenna apparatus 200 include the driven trace 220, the parasitic traces 240, 242, the ground plane 218 (FIG. 3), and the first and second conductive pathways 232, 234. The first and second conductive pathways 232, 234 are vias (e.g., plated thru-holes) that extend through the dielectric body 210. Optionally, the first and second conductive pathways 232, 234 may include additional vias and/or traces embedded within the dielectric body. In some embodiments, the first and second conductive pathways 232, 234 extend parallel to the Z-axis, but the first and second conductive pathways 232, 234 are not required to extend parallel to the Z-axis in other embodiments, such as those that are molded.

In certain embodiments, the driven trace 220 and the parasitic traces 240, 242 are coplanar along an exterior surface 260 of the dielectric body 210. The exposed exterior surface 260 of the dielectric body 210 and the driven trace 220 and the parasitic traces 240, 242 form the first broad side 212. It is contemplated, however, that the driven trace 220 and the parasitic traces 240, 242 are not coplanar in other embodiments and/or are not required to be positioned along an exterior surface of the dielectric body 210. For example, in other embodiments, the driven trace 220 and the parasitic traces 240, 242 may be embedded within the dielectric body 210. The driven trace 220 and the parasitic traces 240, 242 may have different Z-positions (or positions relative to the Z-axis) with respect to one another.

The dielectric body 210 has a first dimension (or length) 262 along the X axis and a second dimension (or width) 264 along the Y axis. In an exemplary embodiment, the antenna apparatus 200 is configured to be secured to another component, such as one having a metallic surface. The ground plane 218 may be positioned between the other component and the dielectric body 210. The ground plane 218 may also be secured directly to the metallic surface.

The parasitic traces 240, 242 are positioned relative to the driven trace 220 to enable the antenna apparatus 200 to communicate within an additional RF band or bands. The additional RF band or bands may be higher than the RF band of the driven trace 220.

In some embodiments, the parasitic traces 240, 242 may operate as passive resonators that absorb the electromagnetic waves from the driven trace 220 and re-radiate the electromagnetic waves at a different RF band. In particular embodiments, the driven trace 220 communicates at first, second, and third RF bands through the first, second, and third branches 222, 224, 226, respectively. The parasitic trace 240 and the parasitic trace 242 may communicate at fourth and fifth RF bands, respectively. For example, the fourth RF band may have a center frequency within the range of 5.15-5.35 GHz. The fifth RF band may have a center frequency within the range of 5.47-5.725 GHz.

The first branch 222, the second branch 224, the third branch 226, and the impedance-tuning portion 230 may be dimensioned to determine the RF band (or bands) at which the driven trace 220 communicates. For example, the first branch 222 has a width 302 and a length 304. The second branch 224 has a width 306 and a length 308. The second branch 224 has a base section 235 that also extends away from the impedance-tuning portion 230 along the Y-axis. The third branch 226 has a width 310 and a length 312. The impedance-tuning portion 230 has a width 314 and a length 316.

As shown, the second and third branches 224, 226 extend away from the impedance-tuning portion 230 in one direction (or first direction) along the X-axis. The first branch 222 extends away from the impedance-tuning portion 230 in an opposite direction (or second direction) along the X-axis. The second and third branches 224, 226 are separated by a gap 290. The widths 306, 310 of the second and third branches 224, 226, respectively, are different. More specifically, the width 310 is shorter than the width 306.

The parasitic traces 240, 242 may also be sized and shaped so that the antenna apparatus achieves a designated performance. For example, respective widths 270, 272 of the parasitic traces 240, 242 may be designated to determine the RF band of the corresponding parasitic trace. As shown, the widths 270, 272 may be uniform (e.g., the width 270) or varying (e.g., the width 272). Respective lengths 274, 276 of the parasitic trace 240, 242 may also be designated to select the RF band of the respective parasitic trace 240, 242.

In addition to the above parameters, a gap 276 between the parasitic trace 240 and an edge 280 of the first branch 222 may be configured to achieve a designated performance. A gap 278 between the parasitic trace 242 and an edge 282 of the first branch 222 may be configured to achieve a designated performance. The edges 280, 282 are on opposite sides of the first branch 222 such that the first branch 222 is positioned between the first and second parasitic traces 240, 242. A distal portion 284 of the second parasitic trace 242 extends beyond an end of the first branch 222 and partially in front of a distal edge 286 of the first branch 222.

As shown in FIG. 6, the first conductive pathway 232 connects to the first branch 222. The second conductive pathway 234 connects to the second branch 224. As such, the impedance-tuning portion 230 is positioned between where the first and second conductive pathways 232, 234 connect to the driven trace 220. Impedance may be tuned or controlled by changing the dimensions, including shape, of the impedance-tuning portion 230. For example, the width 314 of the impedance-tuning portion 230 may be increased or decreased and/or the length 316 of the impedance-tuning portion 230 may be increased or decreased. In addition to the above, the location of the second conductive pathway 234 can be adjusted for impedance-tuning. For example, the second conductive pathway 234 could be moved along at least one of the X-axis or the Y-axis to tune the impedance. Alternatively or in addition to the above, dimensions of a gap or slot 320 that exists between the first and second conductive pathways 232, 234 may be adjusted. For example, a distance between opposing edges of the first branch 222 and the second branch 224 along the X-axis or a depth of the gap 320 along the Y-axis as the gap 320 extends to the impedance tuning portion 230 may be changed.

Accordingly, impedance of the antenna may be based on (a) positions of the first and second conductive pathways 232, 234 relative to each other; (b) dimensions of the impedance-tuning portion 230; (c) dimensions of the gap 320 that exists between the first and second conductive pathways 232, 234; or (d) dimensions of the second conductive pathway 234 (e.g., size of via). The impedance-tuning portion 230 may only affect the RF band (or bands) of the driven trace 220.

Figure 7:
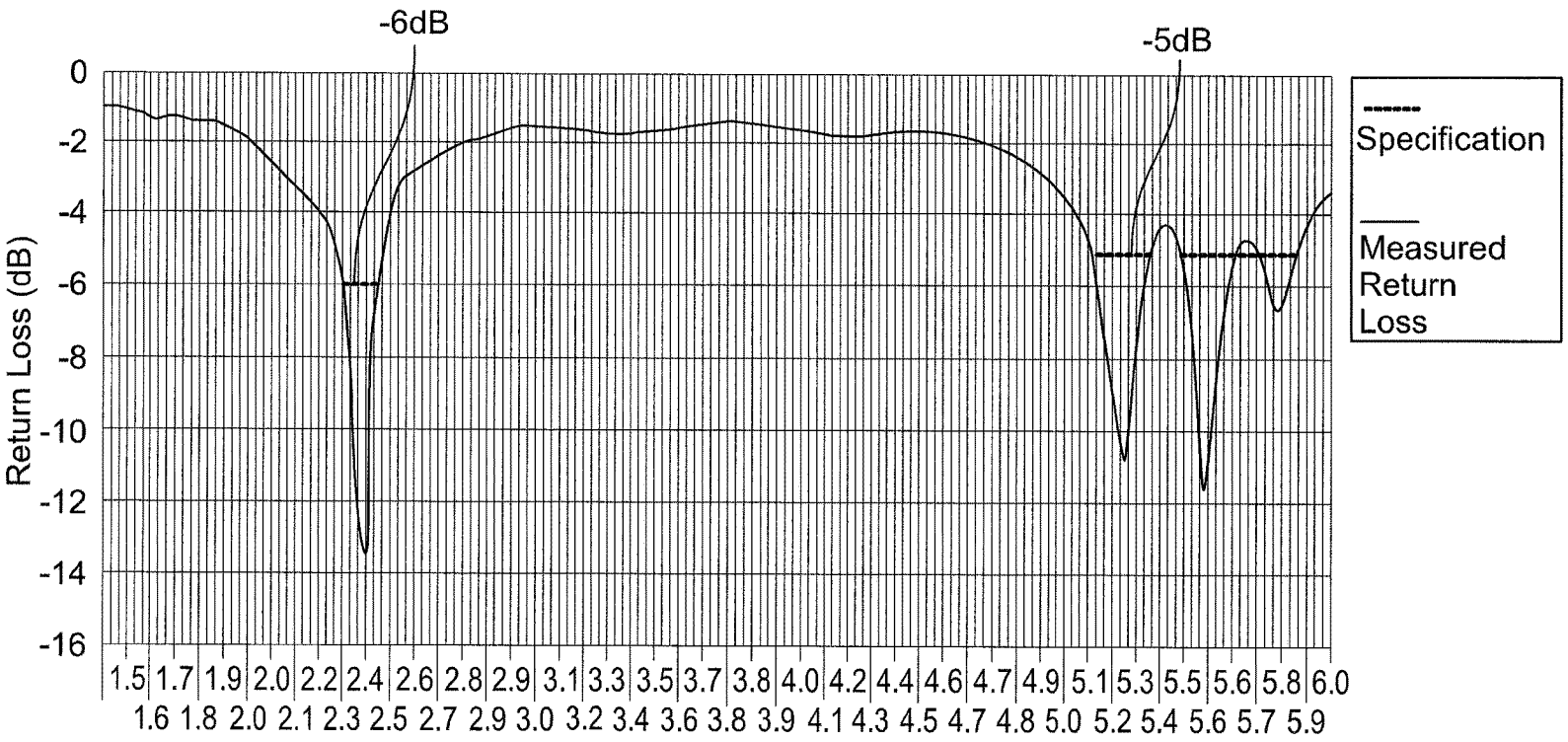
FIG. 7 is a graph illustrating return loss of an antenna apparatus formed in accordance with an embodiment over a wide range of frequencies.

FIG. 7 is a graph illustrating return loss by an antenna apparatus that was formed in accordance with an embodiment. More specifically, an antenna apparatus, such as the antenna apparatus 200 (FIG. 2), was tested through a range of frequencies (1.5 GHz to 6.0 GHz). Between 2.4 and 2.5 GHz, the return loss was less than −6.0 dB. Between 5.15 and 5.35 the return loss was less than −5.0 dB. Between 5.47 and 5.725, the return loss was less than −5.0 dB. Between 5.725 and 5.875, the return loss was less than −5.0 dB. Accordingly, embodiments provide an antenna that is capable of performing effectively within multiple RF bands.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An antenna apparatus comprising:

a dielectric body having first and second broad sides and a thickness of the dielectric body extending therebetween;

a ground plane coupled to the dielectric body;

a driven trace coupled to the dielectric body and extending parallel to the ground plane, the driven trace including a first branch, a second branch, and an impedance-tuning portion that joins the first and second branches, each of the first and second branches configured to resonate at a respective radio-frequency (RF) band;

a first conductive pathway extending from the driven trace through the dielectric body and configured to feed the driven trace;

a second conductive pathway extending from the driven trace through the dielectric body and electrically connecting the driven trace to the ground plane, the impedance-tuning portion extending between the first and second conductive pathways, wherein the first branch extends from the first conductive pathway to a distal edge of the first branch in a first direction and the second branch extends from the second conductive pathway to a distal edge of the second branch in a second direction that is opposite the first direction; and a parasitic trace coupled to the dielectric body, the parasitic trace being planar and extending parallel to the ground plane, the parasitic trace being ungrounded and positioned adjacent to an edge of the first branch, the driven trace exciting the parasitic trace to resonate at a respective RF band that is separate from the respective RF band of the first branch and also separate from the respective RF band of the second branch.

2. The antenna apparatus of claim 1, wherein the driven trace and the ground plane are separated by at most three millimeters.

3. The antenna apparatus of claim 1, wherein the parasitic trace is a first parasitic trace and the respective RF band is a first respective RF band, the antenna apparatus further comprising a second parasitic trace, the second parasitic trace being co-planar with respect to the driven trace, the second parasitic trace being ungrounded and positioned adjacent to an edge of the driven trace, the driven trace exciting the second parasitic trace to resonate at a second respective RF band.

4. The antenna apparatus of claim 3, wherein the first branch is positioned between the first and second parasitic traces, wherein the first and second branches resonate at the same RF band.

5. The antenna apparatus of claim 1, wherein the driven trace also includes a third branch coupled to the impedance-tuning portion, the third branch configured to resonate at a respective RF band.

6. A communication system including the antenna apparatus of claim 1, further comprising a metallic surface, the ground plane being positioned adjacent to the metallic surface.

7. The communication system of claim 6, further comprising a printed circuit that includes the driven trace and the first and second conductive pathways.

8. An antenna apparatus comprising:

a dielectric body having first and second broad sides and a thickness of the dielectric body extending therebetween;

a ground plane;

a driven trace supported by the dielectric body and extending parallel to the ground plane, the driven trace including first and second branches, each of the first and second branches configured to resonate at a respective radio-frequency (RF) band; and a parasitic trace coupled to the dielectric body, the parasitic trace being planar and extending parallel to the ground plane, the parasitic trace being ungrounded and positioned adjacent to an edge of the first branch of the driven trace, the driven trace exciting the parasitic trace to resonate at a respective RF band, wherein the respective RF bands of the first branch and the parasitic trace are separate RF bands;

wherein the parasitic trace is a first parasitic trace and the driven trace excites the first parasitic trace to resonate at a first respective RF band, the antenna apparatus further comprising a second parasitic trace, the second parasitic trace being co-planar with respect to the driven trace, the second parasitic trace being ungrounded and positioned adjacent to an edge of the driven trace, the driven trace exciting the second parasitic trace to resonate at a second respective RF band.

9. The antenna apparatus of claim 8, further comprising:

a first conductive pathway extending from the driven trace through the dielectric body and configured to feed the driven trace; and a second conductive pathway extending from the driven trace through the dielectric body and electrically connecting the driven trace to the ground plane, wherein the antenna apparatus further comprises an impedance-tuning portion extending between the first and second conductive pathways.

10. The antenna apparatus of claim 8, wherein the driven trace and the ground plane are separated by at most three millimeters.

11. The antenna apparatus of claim 8, wherein the first branch is positioned between the first and second parasitic traces.

12. The antenna apparatus of claim 8, wherein the driven trace also includes an impedance-tuning portion that joins the first and second branches and a third branch coupled to the impedance-tuning portion, the third branch configured to resonate at a respective RF band.

13. The antenna apparatus of claim 12, wherein the second and third branches extend away from the impedance-tuning portion in the second direction.

14. A communication system including the antenna apparatus of claim 8, further comprising a metallic surface, the ground plane being positioned adjacent to the metallic surface.

15. The antenna apparatus of claim 8, wherein the respective RF band of the parasitic trace has a higher frequency than the respective RF band of the first branch.

16. An antenna apparatus comprising:

a dielectric body having first and second broad sides and a thickness of the dielectric body extending there between;

a ground plane coupled to the dielectric body;

a driven trace coupled to the dielectric body and extending parallel to the ground plane, the driven trace including a first branch, a second branch, and an impedance-tuning portion that joins the first and second branches, each of the first and second branches configured to resonate at a respective radio-frequency (RF) band;

a first conductive pathway extending from and perpendicular to the first branch of the driven trace through the dielectric body and configured to feed the driven trace;

a second conductive pathway extending from and perpendicular to the second branch of the driven trace through the dielectric body and electrically connecting the driven trace to the ground plane;

wherein a slot is defined by and between the first and second branches, and wherein an end of the slot is defined by the impedance-tuning portion that joins the first and second branches, the slot being positioned between the first and second conductive pathways, the first and second branches extending away from the slot and away from the first and second conductive pathways, respectively, in opposite directions;

wherein the antenna apparatus further comprises:

a parasitic trace coupled to the dielectric body, the parasitic trace being planar and extending parallel to the ground plane, the parasitic trace being ungrounded and positioned adjacent to an edge of the first branch, the driven trace exciting the parasitic trace to resonate at a respective RF band that is separate from the respective RF band of the first branch and also separate from the respective RF band of the second branch.

17. The antenna apparatus of claim 16, wherein the first branch, the second branch, and the impedance-tuning portion are co-planar.

18. The antenna apparatus of claim 16, wherein the slot is defined by and between first and second proximal edges of the first and second branches, respectively, and wherein an edge of the impedance-tuning portion defines the end of the slot, the edge of the impedance-tuning portion and the first and second proximal edges extending parallel to the ground plane.

19. The antenna apparatus of claim 16, wherein the driven trace also includes a third branch coupled to the impedance-tuning portion, the third branch configured to resonate at a respective RF band, wherein the first branch extends away from the slot in a first direction and wherein the second and third branches extend away from the slot in a second direction that is opposite the first direction.

20. The antenna apparatus of claim 8, wherein the first and second respective RF bands of the first and second parasitic traces are each separate from the respective RF bands of the first and second branches.

* * * * *